US005904036A

United States Patent [19]

Machnik et al.

[11] Patent Number: 5,904,036

[45] Date of Patent: May 18, 1999

[54] ROVING FRAME AND METHOD OF OPERATING SAME

[75] Inventors: Franz Machnik, Göppingen; Hans-Peter Weeger, Hattenhofen, both of Germany

[73] Assignee: Zinser Textilmaschinen GmbH, Ebersbach/Fils, Germany

[21] Appl. No.: 08/982,111

[22] Filed: Dec. 1, 1997

[30] Foreign Application Priority Data

Dec. 2, 1996 [DE] Germany ..... 196 49 909

[51] Int. Cl.[6] ..... D01H 1/04

[52] U.S. Cl. ..... 57/67; 57/93; 57/96

[58] Field of Search ..... 57/92, 93, 96, 57/67

[56] References Cited

U.S. PATENT DOCUMENTS

| | | | |
|---|---|---|---|
| 4,375,744 | 3/1983 | Briner et al. | 57/96 |
| 4,409,785 | 10/1983 | Nakane et al. | 57/78 |
| 4,551,969 | 11/1985 | Kogiso et al. | 57/264 |
| 5,522,210 | 6/1996 | Mack | 57/281 |

FOREIGN PATENT DOCUMENTS

| | | |
|---|---|---|
| 1 560 317 | 7/1970 | Germany . |
| 31 19 000 | 2/1982 | Germany . |
| 195 27 339 | 10/1996 | Germany . |

*Primary Examiner*—William Stryjewski
*Attorney, Agent, or Firm*—Herbert Dubno

[57] ABSTRACT

A roving frame has a drafting frame receiving sliver and feeding rovings to respective roving winding stations. Respective spindles at these stations receive core sleeves on which the roving bobbins are wound for respective flyers. An evaluating and control device is operatively connected to the drive for automatically or on command, operating the flyers at a first gentle speed less than the operating speed and a speed required for automatic capture of roving ends by the core sleeves, automatically or on command, operating the flyers at a second gentle speed less than the operating speed, greater than the first gentle speed and sufficient for automatic capture of roving ends by the core sleeves, and automatically or on command, operating the flyers at a creeping third gentle speed less than the first gentle speed for startup and to position the flyers at selected angular positions.

17 Claims, 4 Drawing Sheets

ROVING FRAME AND METHOD OF OPERATING SAME

FIELD OF THE INVENTION

Our present invention relates to a roving frame and to a method of operating such a roving frame.

BACKGROUND OF THE INVENTION

A roving frame generally comprises, between the cans which supply the sliver and the flyers which cooperate with the spindle to wind the roving on the core sleeves to form the roving bobbins, a drafting frame or unit which drafts the sliver.

The flyers can have a drive with a control speed and can have fingers which supply the roving to the core sleeve. After the repair of a roving break or following a doffing operation, it has been the practice to delay reestablishment of the so-called operating speed, i.e. the elevated speed at which the roving is applied to the core sleeve in the formation of the roving bottom, for a certain period of time with which the roving frame is driven at a substantially lower speed which can be referred to as a start-up speed, an inching or gentle speed, or simply as the slow speed.

The purpose of operating the roving frame at this substantially reduced speed is to allow the tension applied to the sliver to be minimized during the start-up phase and thereby possibly avoid a new break in the sliver in the region in which is meets the core sleeve and to prevent the sliver which is applied to the core sleeve initially from pulling off from the latter. Operation at a reduced speed also allows service personnel to monitor the start-up of the roving frame and the application of the roving or sliver to the core sleeves at such start-up. After this initial operation at a gentle speed, the roving frame can be accelerated to its normal operating speed.

It is known (see for example DE 31 19 00 C2) to avoid a sag in the sliver between the drafting frame and the flyer while the roving frame is operating at this gentle speed and thereby avoid a further possibility of sliver breakage. In this case during the start-up of the flyer after a doffing, the pressing fingers of the flyers can be automatically brought into contact with the core sleeves to cause the sliver ends to contact the capture regions of the empty sleeves. By avoiding the sliver sag, which can result because the drafting frame begins operation before the roving is wound up sufficiently or because the capture of the sliver end may be delayed, the operation during the gentle speed stage may be carried out with a slight increase in speed so that the winding of the sliver onto the core sleeve can occur at a speed which is slightly higher than the feed speed of the sliver.

When the pressing finger of the flyer is configured as described in DE 15 60 317, such that the pressing finger is urged against the capture region of the sleeve by the effect of centrifugal force, for the attainment of a sufficient pressing force, a certain minimum speed is required. This can, for example, be between 250 and 300 RPM.

On the other hand there is the danger that in the selection of such an elevated gentle speed after a fresh start-up of the roving frame following elimination of a sliver break, a force is applied at the point at which the sliver will meet the core sleeve that might result in a new breakage. Furthermore, if the gentle speed which is selected is excessive, it might cause injury to operating personnel who may be involved in manipulations in the region of a flyer.

As a consequence it has been proposed to provide a roving frame of the type described with two gentle speeds, i.e. two preliminary speeds prior to switch-over to the normal operating speed. A lower first gentle speed is used for the initial start-up of the machine following a roving break or for the start-up of a particular flyer position or the safe manipulation of the roving or sleeve in the machine. A second gentle speed, higher than the first but still significantly lower than the operating speed, is used for start-up of the machine following a doffing operation and where problems with sag are to be avoided. This system has an advantage that, following a doffing operation, one can operate selectively with the sufficiently high gentle speed that is required to ensure the application of the pressing finger to the sliver capture region of the core sleeve with sufficient force and thus reliable capture of the sliver end. However, when the first lower gentle speed is selected, especially after a break of the sliver or roving, the force applied to the sliver is significantly less so that a new roving break can be avoided.

It will be understood that the first or lower gentle speed can be used not only to avoid a new roving break in the region between the drafting frame and the bobbin after repair of a previous break, but also for the feeding of a sliver end from a can to the side of the respective drafting station of the drafting frame. The lower gentle speed, as a general matter, thereby ensures a lesser force in the region leading up to the bobbin over the entire machine path and can permit adjustment of the flyer to a certain angular position when, for example, a manual doffing process is to be undertaken.

To maximize productivity of a machine, the first or lower gentle speed should be high enough as to ensure that a roving break will not follow upon acceleration to the higher spinning forces or to endanger a service person whose hand may be in the path of moving parts of the spinning unit. The first gentle speed is preferably in the range of 90 RPM of the flyer.

This is, however, disadvantageous if a defined angular position of the flyers is to be set as, for example, can be necessary for manual doffing processes. When the latter is the available slow speed, many tries are frequently required for short-term actuation of the drive in order to bring about the desired position of the flyers. Furthermore, this latter gentle speed is too high for test runs designed to enable a service person to observe the spinning process or other specific functions of the machine.

Such functions cannot be ensured with the roving frame of DE 31 19 000 C2.

OBJECTS OF THE INVENTION

It is, therefore, the principal object of the present invention to provide a roving frame which reliably can effect capture of the roving ends following a doffing operation and yet a danger to service personnel as a result of excessive speed of the machine following a roving break or manipulations in the path of moving parts thereof during gentle speed machine operations.

Another object of this invention is to provide an improved roving frame with a simpler start-up and which enables defined angular positions of the flyers to be established.

It is also an object of the invention to provide a method of operating a roving frame with improved speed and reliability and especially so as to enable improved observation of machine functions during test runs and the like.

SUMMARY OF THE INVENTION

These objects and others which will become apparent hereinafter are attained, in accordance with the invention in a roving frame having:

a drafting frame receiving sliver and feeding rovings to respective roving winding stations;

respective spindles at the stations receiving core sleeves onto which respective roving bobbins are wound;

respective flyers at the stations having pressing fingers applying roving ends to capture regions of the core sleeves and feeding respective rovings onto the roving bobbins during winding thereof;

a drive unit operatively connected with the flyers for forming the bobbins at an operating speed of the flyers; and evaluating and control means operatively connected to the drive unit for automatically or on command, operating the flyers at a first gentle speed less than the operating speed and a speed required for automatic capture of roving ends by the core sleeves, automatically or on command, operating the flyers at a second gentle speed less than the operating speed, greater than the first gentle speed and sufficient for automatic capture of roving ends by the core sleeves, and automatically or on command, operating the flyers at a creeping third gentle speed less than the first gentle speed for startup and to position the flyers at selected angular positions.

The method of operating the roving frame can therefore comprise the step of automatically operating the flyers at a first gentle speed less than the operating speed and also less than the speed required for automatic capture of roving ends by the core sleeves for the gentle speed operation necessary to wind up the roving after repair of a roving break or the like.

The drive unit is automatically or on command operated at a second gentle speed greater than the first following a doffing operation. Finally, the driving unit is operated automatically or on command by the evaluating and control means at a creeping speed, i.e. a third gentle speed, less than the first gentle speed for start-up and to position the flyers at predetermined angular positions.

The system of the invention has the advantage that it simplifies service of the roving frame because three different gentle speeds are provided for different manual inventions in the functions of the machine selectively. The evaluation and control unit can be provided with a start button and can be supplied with at least one selection signal which allows the selection of the control functions between at least two distinct operating modes upon actuation of the start-up button.

In a preferred embodiment of the invention the flyers of the roving frame are at least partly covered by a shield which can be opened or raised and the selection signal is a signal outputted by one or more sensors on the shield or on at least one of the shields and which can detect the closed and open positions of the shield.

This embodiment has the advantage that for a manual intervention with the moving parts of the machine it is necessary to open the or each shield and upon such opening the requisite mode of operation is selected upon the actuation of the start button.

Apart from simplified serviceability, injury to the service personnel can be prevented and fail-safe service can be ensured.

In this preferred embodiment of the invention the evaluation and control unit limits the speed to a maximum of the first gentle speed upon the detection of at least one open shield. This also guarantees the safety of operating personnel, especially when the first gentle speed is selected so that it is about 90 RPM of the flyers.

In another embodiment of the invention, in the case of actuation of the start button and at least one open shield, when the machine is in standstill, over an actuating time period which is smaller than a predetermined time threshold, the machine is held at the creeping speed or is accelerated to the creeping speed and held there. This speed can be so low that, for example, a simple starting by the actuation of a start button and stopping by actuation of the stop button can rotate the flyers into the predetermined angular positions. Since the start-up into a predetermined angular position of the flyers is possible within one revolution of each flyer or within several revolutions of the flyers, the evaluation and control unit can bring the drive unit to standstill after a predetermined time period or after a predetermined number of revolutions of the flyers.

In a preferred embodiment of the invention, upon actuation of the start button when the machine is originally at standstill and with at least one open shield of the machine, the machine is accelerated to the creeping speed and held there for a predetermined time duration. Thereafter the machine is accelerated to the first gentle speed upon actuation of the start button in a longer period of time than the time threshold. The machine is then brought to standstill as soon as the actuation of the start button is terminated.

In this manner it is possible to operate the start button only over a short period corresponding to a test run.

According to another feature of the invention, upon the detection of fully-closed shields of the machine, actuation of the start button when the machine is at standstill can be effected for a duration which is smaller than a further threshold and then accelerated to the operating speed of the flyers.

By contrast, when only closed covers are detected upon actuation of the start button from standstill of the machine, for a time period which is greater than the further threshold, the drive unit is preferably initially switched to the second gentle speed and following the actuation interval of the start button is accelerated to the drive speed of the flyers which can be in the range of 800 to 1800 RPM. The second gentle speed is preferably in the range of about 250 to 300 RPM of the flyers.

In a preferred embodiment of the invention, upon actuation of the start button during a drive phase of the machine with a speed which is greater than the second gentle speed, the machine is decelerated to the second gentle speed and after the actuation of the start button, the machine is accelerated from the second gentle speed to the operating speed. With this functioning of the start button depending upon a selection signal, we can achieve simple serviceability of the machine since the three gentle speeds are used for their distinct functions.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
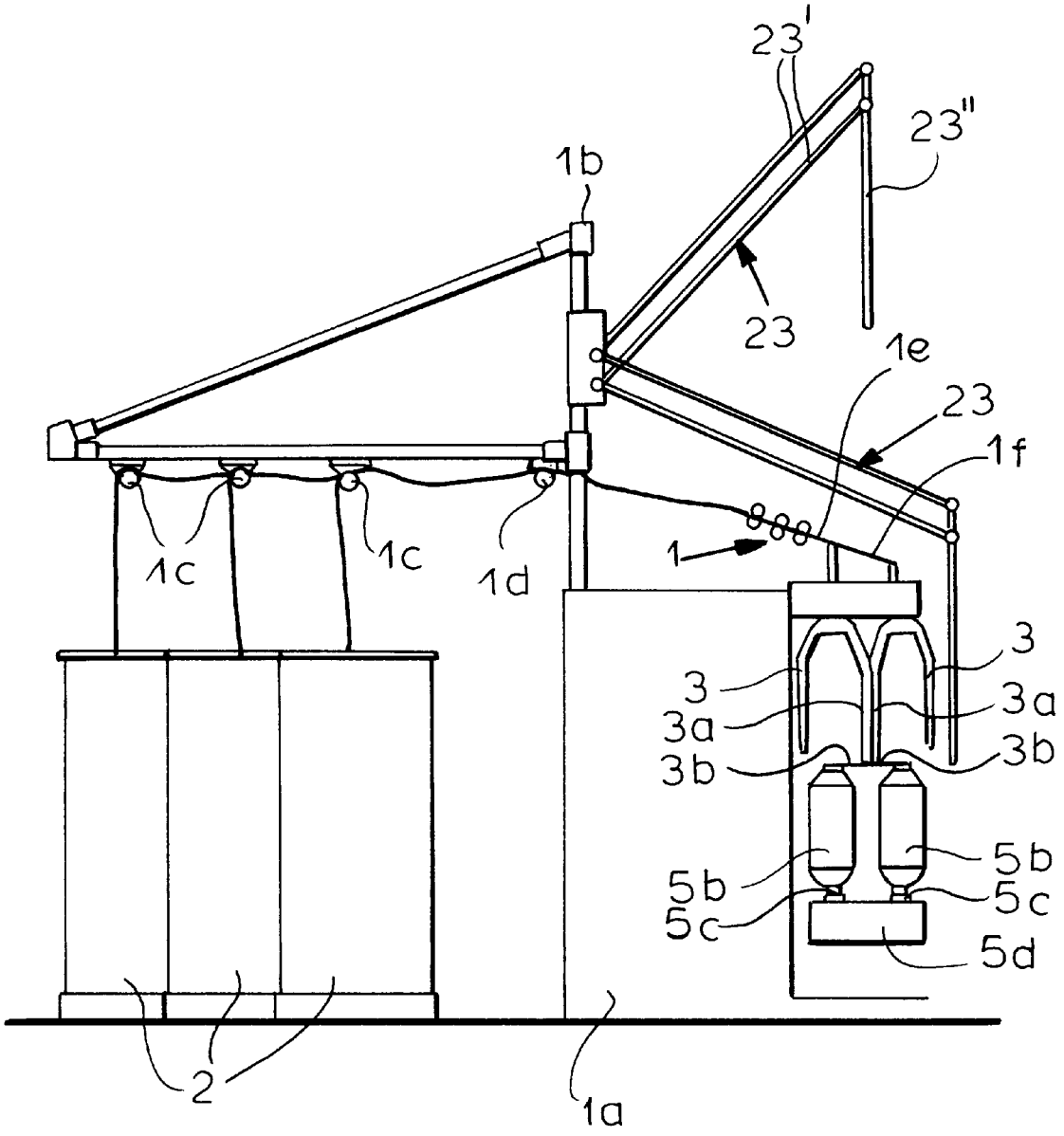
FIG. 1 is a side elevational view of a roving frame in accordance with the invention.

FIG. 1 is a view of a flyer or roving frame according to the invention and comprises a machine stand la provided with a drafting frame 1 and a support 1*b* for guides 1*c* feeding slubbing from respective cans 2 over guides 1*d* to the drafting frame 1. The drafted roving at 1*e* and 1*f* is supplied to flyers 3 whose shanks 3*a* have fingers 3*b* which press the roving onto roving bobbins 5*b* formed on cores sleeves 5 (FIG. 2) on spindles 5*c* of a spindle rail 5*d*.

The flyers 3 are provided in two rows, as are the spindles 5*c* and, in a conventional manner the spindle rail 5*d* can raise and lower during the winding of bobbins 5*b*. The system can, of course, be provided with a doffing arrangement for removing full bobbins and delivering the empty core sleeves and for fitting empty sleeves on the spindles from which the full bobbins have been removed. The drafting frame 1 can, as can be seen from FIGS. 1 and 2, comprise three roller pairs 1*g*, 1*h* and 1*i*, respectively.

Each roving is fed through the respective flyer 3 to the lower end of one of the flyer arms equipped with the pressing finger 3*b* in which it is applied to the respective core sleeve 5. The spindles on which the core sleeves 5 are fitted can be provided with a drive unit represented at 9 in FIG. 2. The drive of the spindles and their vertical displacement are so coordinated, so as to form the standard biconical shape of the bobbins. The drive 9 thus also represents the drive for the drafting frame 1, the flyers 3, the spindles and the raising and lowering mechanism of the spindle rail, the speeds of each of these systems being coordinated as is conventional by the usual spinning laws in roving spinning. The drive unit 9 can, for example, include a central drive motor with branching transmissions to the various moving elements, or a multiplicity of drive motors for the respective functions.

As is also apparent from FIG. 1, where rotating elements are provided, one or more covers 23 can be mounted as shields for protecting service personnel from coming into contact with the moving parts, e.g. the flyers. Each cover can have a system enabling it to be displaced into various positions as has been shown in FIG. 1. The covers may also shield a plurality of flyers or stations.

As can be seen from FIG. 1, for example, a shield 23 may have a parallelogramatic linkage 23' connected between the support 1*b* and a plate 23" which forms the actual cover for a multiplicity of flyers. The shield can thus be swung about horizontal axes parallel to the longitudinal axis of the machine.

Figure 2:
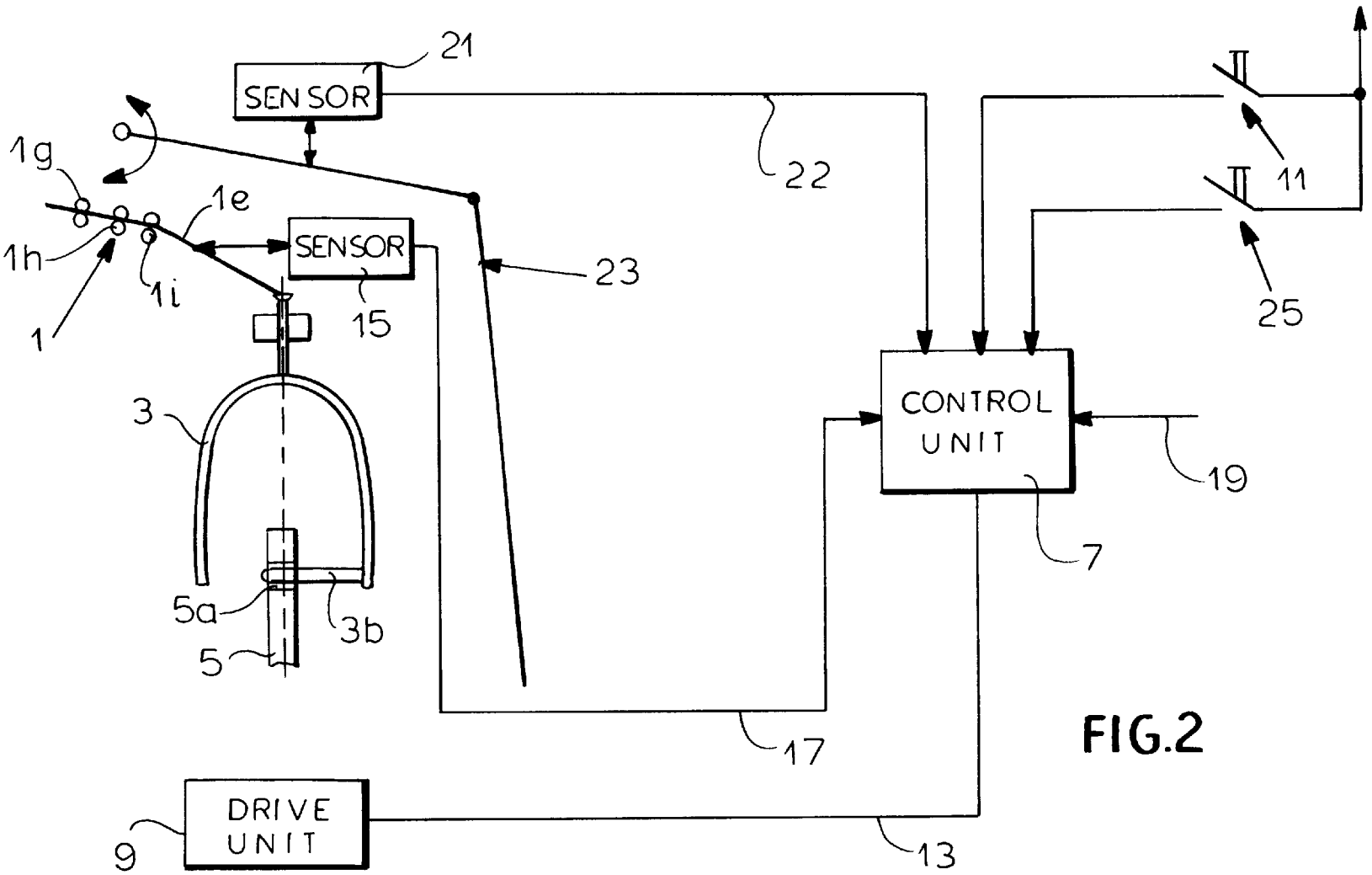
FIG. 2 is a diagram illustrating the control system for the flyer drive for the machine of FIG. 1.

In FIG. 2 only a single flyer has been shown schematically at 3 and can correspond to one of the flyers of either flyer row. It has a pressing finger 3*b* which can apply the roving to a roving-capture region 5a of the flyer 5. The drive unit 9 is controlled by a control unit 7 which evaluates, in addition, signals from sensors 21 of the position of the shields 23 and sensors 15 monitoring the roving 1e between the drafting frame 1 and the flyer.

The drive unit encompasses, as has already been indicated, at least one electric motor for the functions of drafting (driving the drafting frame), twisting (driving the flyers) and bobbin winding (rotation of the spindles and vertical displacement of the spindles to generate the usual biconical bobbin structure). The individual functions may be provided with independently controlled stepless transmissions so that, for example, individual electric motors can be controlled for each of the drives, or a common drive can be provided with individual stepless power take-offs for the various driving elements. All of these alternatives can be considered integrated in the block represented at 9.

A start button 11 and a stop button 25 can be connected to the control unit 7.

The sensor 15 monitors breakage of the roving and can transmit a roving break signal 17 to the control unit as soon as a rupture of a single roving is detected. Each of the many stations or a number of group of stations can be provided with a separate roving break sensor or sensors can be provided for the individual slubbing or groups of slubbing.

The evaluation and control unit 7 is supplied with a further signal 19 which can be derived from a manually-operated button or switch (not shown) or from a machine-control circuit which is superimposed upon the circuit shown. The sensors 21 detect the open or closed positions of the shields 23. Instead of a single sensor for each shield, several shields can be provided with a sensor or one sensor can be provided for all of the shields.

When the evaluation and control unit detects at 15 a roving break, the unit 9 is brought to standstill by the application of a corresponding signal 13 thereto. The evaluation and control unit 7, of course, recognizes that the standstill is brought about by a roving break and thus that the machine is to be restarted upon curing of the roving break. If the shield or cover 23 is still open following cure of the roving break or for such cure, the start-up of the machine is effected at the first or lower gentle speed. If all of the shields 23 are closed, the machine is accelerated to the second or higher gentle speed. These speeds are maintained to keep the tension in the repair region sufficiently low that a new break does not occur.

Of course, even in the case of a closed shield, the machine can be brought to the first gentle speed on start-up when excessive tension is feared and there is a danger of a roving break. The first gentle speed, as has been noted, is preferably in the range of about 90 RPM of the flyers and is selected to keep the tension on the roving sufficiently low as to avoid a new break and also practically exclude any danger of service personnel whose hands may have intervened in the roving repair operation. It is because of this that the evaluation and control unit will automatically return the drive to the first gentle speed upon opening of one or more shields.

When the drive has been brought to standstill by the signal 19, this is also recognized by the evaluation and control unit and may be the case for a doffing operation so that the machine must next be prepared for the capture of roving ends from the pressing fingers of the flyers. For this the machine must operate at the second or higher gentle speed at which capture of the roving ends is ensured. After capture of the roving ends, the machine is brought to its operating speed provided that none of the sensors 21 detect an open shield.

For automated roving attachment and following a doffing process, the evaluation and control unit 7 can be automatically actuated to effect the doffing or roving pick-up operation by a remote control unit, for example, or by an automatic signal.

In either case by manipulation of the START and STOP buttons 11 and 25, manual operation of the spinning frame can be effected.

If the evaluation and control unit 7 recognizes that the last standstill was a result of a roving breakage, then the subsequent actuation of the START button 11 will automatically bring the machine to the first gentle speed which is maintained for a predetermined time to permit startup without breakage, before the machine is restored to its operating speed.

If the evaluation and control unit 7 recognizes, however, that the previous standstill was a result of the signal 19 and hence a doffing operation, the subsequent actuation of the START button 11 will automatically bring the machine to the second gentle speed assuming all of the shields are closed. This is maintained for a predetermined time period, whereupon the machine can be accelerated to the operating speed. If the standstill has been effected during regular operation by actuation of the STOP button, the evaluation and control unit upon a new actuation of the START button, assuming all of the shields 23 are closed, will accelerate the machine to the operating speed. If there is an open shield, the machine will be accelerated to the first gentle speed.

Instead of an automatic determination of the time periods for the respective gentle speeds, the time period can depend upon manual operation, for example, release of the START button. This arrangement allows interpretation of the signal from the START button by the evaluation and control unit 7.

Figure 3A:
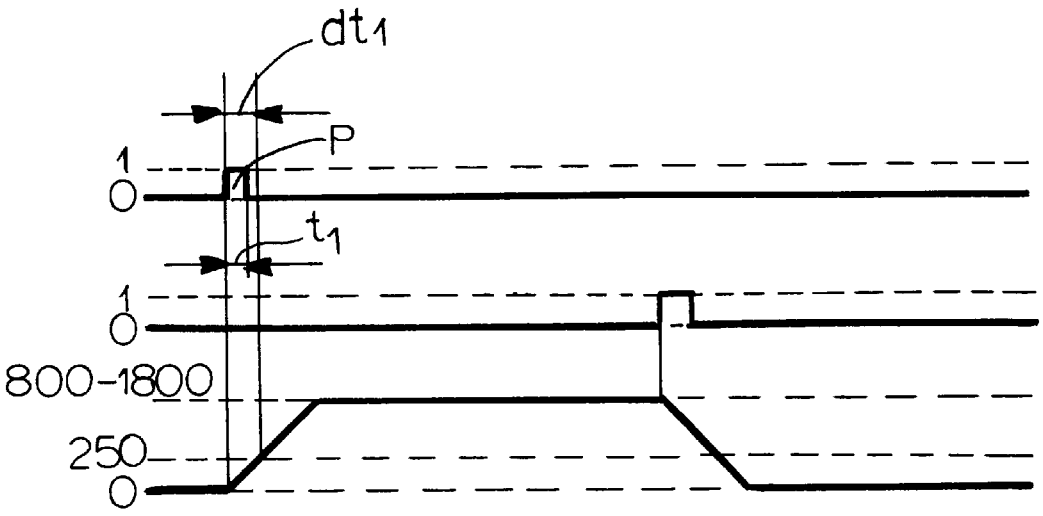
FIGS. 3*a* and 3*b* are timing diagrams showing stages in the servicing of a flyer frame when the flyer covers are closed.
Figure 3B:
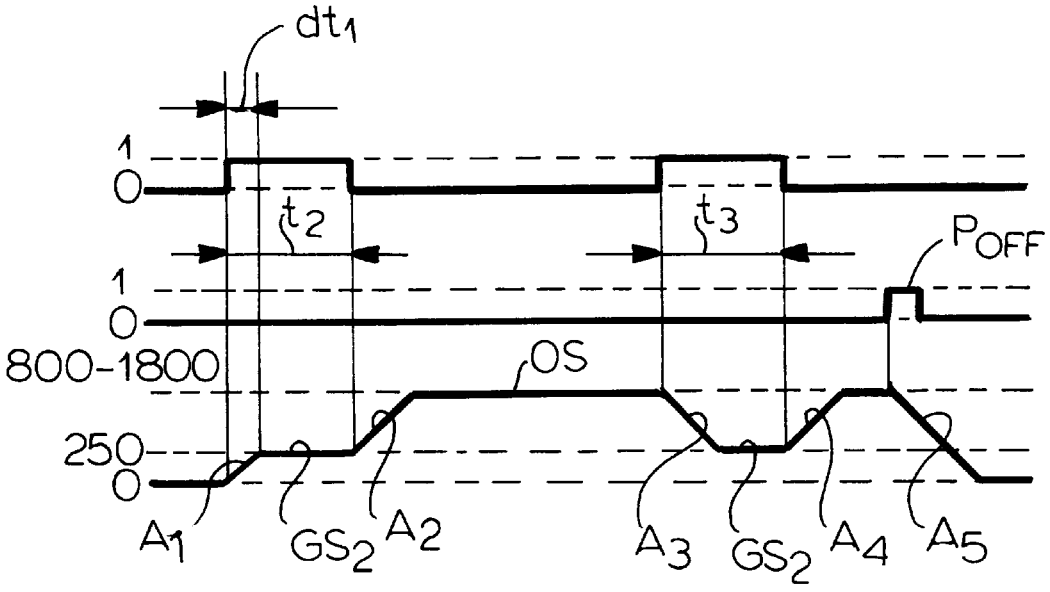

In FIGS. 3*a* and 3*b*, for the lower graph the speed is plotted along the ordinate and against time along the abscissa. The first gentle speed is lower than or equal to the maximum permissible speed in the case of at least one open shield. The second gentle speed is higher.

When a short START signal is generated by means of the START button 11 in the case in which the machine is at standstill at $t_1$, there is an immediate acceleration of the machine to the operating speed. The START pulse has been represented at P in FIG. 3*a* and the operating speed at OS.

The evaluation and control unit establishes the time period $t_1$, which can represent the duration of actuation of the START button and compares with a threshold $dt_1$. If $t_1$ is smaller than $dt_1$, the machine is accelerated immediately to the operating speed OS.

In the case of FIG. 3*b*, where $dt_1$ is less than a threshold $t_2$, i.e. the pushbutton is held on for the period $t_2$, the machine is accelerated.

In the diagrams of FIGS. 3*a*, 3*b*, 4*a* and 4*b*, the upper timing diagram represents the actuation of the START button and the duration of such actuation while the second diagram represents the actuation of the STOP button. The third diagram, of course, represents the flyer speed.

It will be understood that the evaluation and control unit 7 can also detect whether the button 11 is still depressed at the end of the time threshold $dt_1$ or not to effect the corresponding operation. The time threshold $dt_1$ is preferably so selected that it ends approximately at the point in time that the second gentle speed would be reached during normal start-up of the machine (see FIG. 3*a*) although it can be shorter.

If the individual servicing the machine is aware that an immediate acceleration of the operating speed is not permissible, as is the case after a roving break or a doffing operation, he or she can build up the speed of the machine by holding the START button 11 depressed for a time period $t_2$ which is greater than the threshold $dt_1$.

Of course in a similar way, depending upon a selection signal, a plateau can be provided for the first gentle speed at about 90 flyer rotations per minute. At the end of the period $t_2$, i.e. upon release of the pushbutton 11, the drive unit 9 can be accelerated via the ramp $A_2$ to operate speed OS (FIG. 3*b*).

The evaluation and control unit thus can automatically set the machine for the first or second gentle speed initially depending upon whether a shield 23 is open or all of the shields 23 are closed.

In the case of a roving break, it may be desirable to hold the speed of the machine significantly below the first gentle threshold as a safety factor when at least one of the shields 23 is open according to the present invention. In this case, when all of the shields 23 have been closed, the machine will be accelerated to the second gentle speed whenever the START button 11 is held actuated for longer than the threshold $dt_1$. This operation can be achieved with conventional logic circuitry in the evaluation and control unit 7.

When, following a roving break, it is desired to build up the speed to one greater than the first gentle speed, this can be achieved for a short test run while at least one of the shields 23 is open. This generally does not require any special effort since at least one of the shields is open following such a roving break. As FIG. 3*b* shows, the evaluation and control unit 7, upon actuation of the START button 11, during the operating phase of unit 9 can be actuated to reduce the flyer speed to the second gentle level GS2 over the interval $t_3$ via the ramp $d_3$. In this case the button 11 is depressed for the interval $t_3$. Thereafter, the speed is restored (ramp $A_4$,) to the operating speed and, upon depression of the STOP button 25, contributing the pulse $P_{OFF}$, the speed declines (ramp $A_5$) to zero.

Figure 4A:
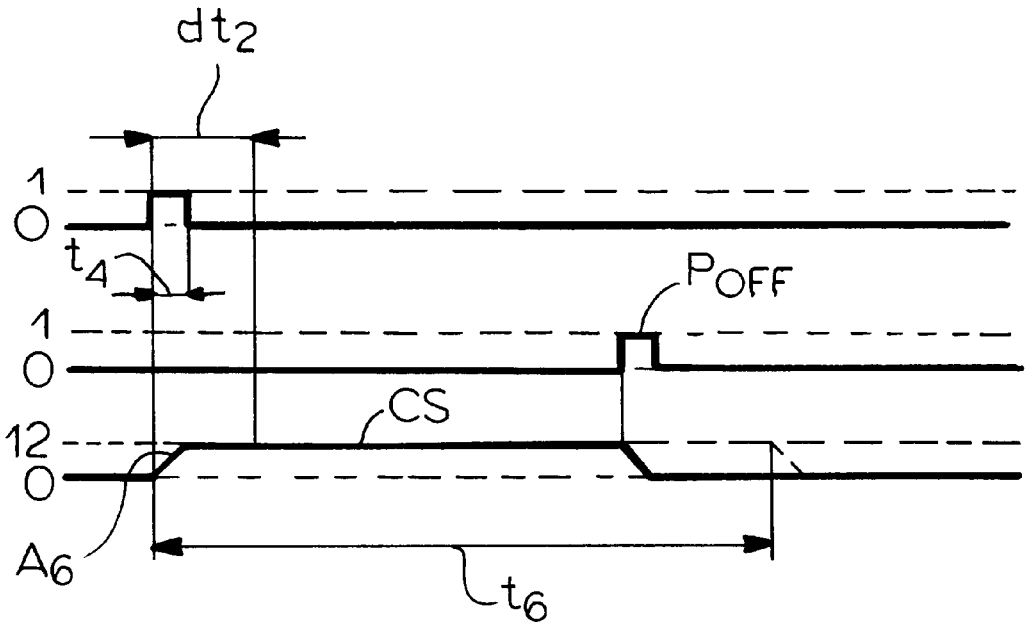
FIGS. 4*a* and 4*b* are diagrams for elucidating the operating for manual intervention in the case of an open flyer cover.
Figure 4B:
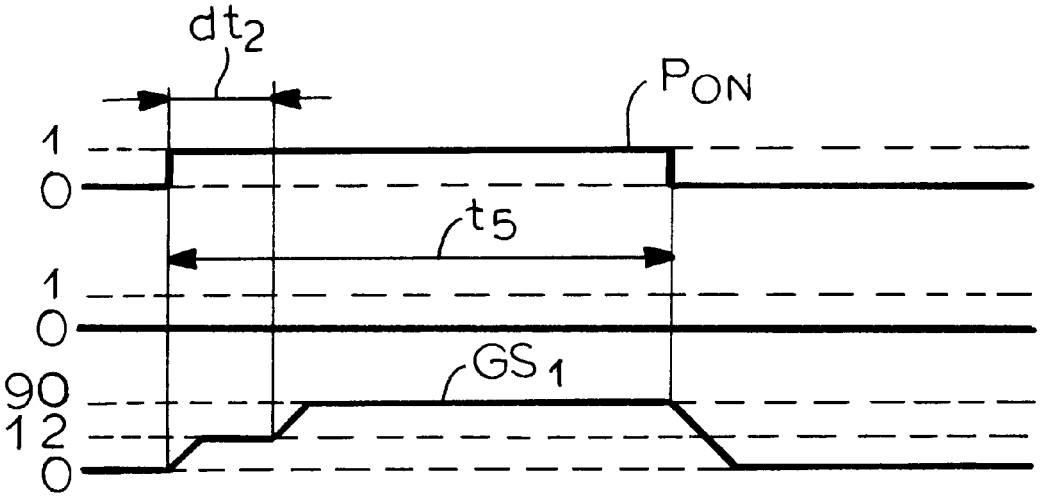

FIGS. 4*a* and 4*b* show the functions of the START button 11 when the logic circuitry of the evaluation and control unit detects at least one open shield 23, corresponding to the application of a signal 22 to the circuit 7.

When the START button 11 is depressed in this case for the time period $t_4$, (FIG. 4*a*) which is shorter than the threshold $dt_2$, a creeping speed is established as represented by the ramp $A_6$ to a level CS which is low enough that a defined positioning of the flyer 3 is possible. The flyer can be brought to standstill by the $P_{OFF}$ pulse resulting from a depression of the STOP button 25.

As FIG. 4*a* shows, the machine after a predetermined time interval $t_6$ or a predetermined number of flyer revolutions, comes to standstill.

If the START button 11 is depressed for a longer period of time than the threshold $d_2$ as represented by the $P_{ON}$ pulse shown in FIG. 4*b*, evaluation and control unit 7 initially yields the creeping speed and then at the time $dt_2$ accelerates the machine to the first gentle speed $GS_1$. The latter is maintained as long as the START button 11 is depressed (time $t_5$) whereupon the machine returns to standstill. In this manner, when a shield 23 is open, a number of test runs of the machine can be effected to enable observation of a serviced portion of the machine. This allows for servicing of the machine and ensures that a service person can determine that the machine is operating properly before the shield is closed and operation begun as has been described in connection with FIGS. 3*a* and 3*b*.

We claim:

1. A roving frame comprising:

a drafting frame receiving sliver and feeding rovings to respective roving winding stations;

respective spindles at said stations receiving core sleeves onto which respective roving bobbins are wound;

respective flyers at said stations having pressing fingers applying roving ends to capture regions of said core sleeves and feeding respective rovings onto said roving bobbins during winding thereof;

a drive unit operatively connected with said flyers for forming said bobbins at an operating speed of said flyers; and evaluating and control means operatively connected to said drive unit for automatically or on command, operating said flyers at a first gentle speed less than said operating speed and a speed required for automatic capture of roving ends by said core sleeves, automatically or on command, operating said flyers at a second gentle speed less than said operating speed, greater than said first gentle speed and sufficient for automatic capture of roving ends by said core sleeves, and automatically or on command, operating said flyers at a creeping third gentle speed less than said first gentle speed for startup and to position said flyers at selected angular positions.

2. The roving frame defined in claim 1 wherein said evaluating and control means is provided with a START button.

3. The roving frame defined in claim 2 wherein said evaluating and control means is provided with means for selecting between two different sets of speed sequences of the drive unit both initiated by actuation of said START button.

4. The roving frame defined in claim 3, further comprising at least one shield in a region of said flyers and means for detecting opening of said shield and generating a selection signal for said evaluating and control means.

5. The roving frame defined in claim 4, further comprising means for detecting an open position of said shield for limiting speed of said flyers to a speed preventing injury to service personnel.

6. The roving frame defined in claim 5 wherein said mechanism speed preventing injury is said first gentle speed.

7. The roving frame defined in claim 4 wherein, upon actuation of said START button with said drive unit at standstill and said shield in an open position, said drive unit is accelerated to said creeping third gentle speed.

8. The roving frame defined in claim 7 wherein said evaluating and control unit operates said drive unit for a predetermined time period or a predetermined number of revolutions of said flyers at said creeping speed before bringing said drive unit to standstill.

9. The roving frame defined in claim 4 wherein said evaluating and control unit is constructed and arranged so that upon actuation of said START button with said drive unit at standstill and said shield in an open position, for an actuation time of said START button that is greater than a predetermined threshold, said evaluating and control means brings said drive unit initially to said creeping speed, holds said creeping speed for a predetermined interval and then accelerates said drive unit to said first gentle speed.

10. The roving frame defined in claim 4 wherein said evaluating and control means is constructed and arranged to bring said drive unit to standstill upon release of said START button.

11. The roving frame defined in claim 4 wherein said evaluating and control means is constructed and arranged so that, upon detection of only closed shields and upon an actuation of said START button with said drive unit at standstill for a time interval less than a threshold, the drive unit is accelerated to said operating speed.

12. The roving frame defined in claim 11 wherein said evaluating and control unit is constructed and arranged upon actuation of the START button for a time period during operation of said unit at said operating speed to decelerate said drive unit to said second gentle speed.

13. The roving frame defined in claim,12 wherein upon release of said START button after deceleration, said drive unit is accelerated again to said operating speed.

14. The roving frame defined in claim 4 wherein said evaluating and control means is constructed and arranged so that, upon detection of only closed shields and upon an actuation of said START button with said drive unit at standstill for a time interval less than a threshold, the drive unit is initially accelerated to said second gentle speed.

15. The roving frame defined in claim 14 wherein said evaluating and control means is constructed and arranged to accelerate said drive unit to said operating speed upon release of the START button from said second gentle speed.

16. The roving frame defined in claim 1, further comprising a STOP button connected to said evaluating and control for bringing said drive unit to standstill.

17. A method of operating a roving frame comprising:

a drafting frame receiving sliver and feeding rovings to respective roving winding stations;

respective spindles at said stations receiving core sleeves onto which respective roving bobbins are wound;

respective flyers at said stations having pressing fingers applying roving ends to capture regions of said core sleeves and feeding respective rovings onto said roving bobbins during winding thereof;

a drive unit operatively connected with said flyers for forming said bobbins at an operating speed of said flyers; and evaluating and control means operatively connected to said drive unit, said method comprising the steps of:

automatically or on command, operating said flyers at a first gentle speed less than said operating speed and a speed required for automatic capture of roving ends by said core sleeves, automatically or on command, operating said flyers at a second gentle speed less than said operating speed, greater than said first gentle speed and sufficient for automatic capture of roving ends by said core sleeves, and automatically or on command, operating said flyers at a creeping third gentle speed less than said first gentle speed for startup and to position said flyers at selected angular positions.

* * * * *